United States Patent [19]

Davis et al.

[11] 4,401,435

[45] * Aug. 30, 1983

[54] OXIDIZING MEDIUM FOR DYES

[75] Inventors: Ralph A. Davis; Randy C. Stauffer, both of Midland, Mich.

[73] Assignee: The Dow Chemical Co., Midland, Mich.

[ * ] Notice: The portion of the term of this patent subsequent to Mar. 23, 1999 has been disclaimed.

[21] Appl. No.: 140,358

[22] Filed: Apr. 14, 1980

[51] Int. Cl.[3] ..... D06P 1/22; D06P 1/28

[52] U.S. Cl. ..... 8/627; 8/650/651; 252/186.1

[58] Field of Search ..... 8/627, 651

[56] References Cited

U.S. PATENT DOCUMENTS

| | | | |
|---|---|---|---|
| 3,716,325 | 2/1973 | Aspland | 8/657 |
| 3,775,047 | 11/1973 | Weston | 8/634 |
| 3,944,382 | 3/1976 | Doerr | 8/627 |
| 4,011,042 | 3/1977 | Stitzel | 8/650 |
| 4,012,192 | 3/1977 | Doerr | 8/627 |
| 4,042,139 | 8/1977 | Baum et al. | 8/634 |
| 4,131,423 | 12/1978 | Kato | 8/650 |
| 4,155,709 | 5/1979 | Doerr | 8/627 |
| 4,321,054 | 3/1982 | Davis et al. | 8/651 |

OTHER PUBLICATIONS

Chem. Abstract, vol. 63, 12375d, (1965).
Chem. Abstr., vol. 63, 17189c, (1965).
Chem. Abstr., vol. 68, 6741t, (1968).
Babko et al, Ukr. Khim, Zhurnal, vol. 33, No. 8, pp. 866–867, (1967).

*Primary Examiner*—Maria Parrish Tungol
*Attorney, Agent, or Firm*—Robert W. Selby

[57] ABSTRACT

An acidic, aqueous oxidant including ionized bromate, iodate and a soluble vanadium-containing material.

7 Claims, No Drawings

OXIDIZING MEDIUM FOR DYES

BACKGROUND OF THE INVENTION

This invention relates to an improved oxidant and more in particular to an acidic, aqueous, oxidizing agent containing bromate and iodate ions.

Dyeing of various fabrics to impart a color to the fiber has been practiced for many centuries. The color must generally be permanently and uniformly distributed throughout the fiber and not merely superficially applied to the fiber as in painting. Many different types of natural and regenerated cellulosic fibers have been dyed to impart a color. For example, natural fibers, such as the vegetable fibers cotton, linen, jute, and flax have been dyed. Regenerated cellulosic fibers, such as viscose rayon and cellulose acetate, are those produced from natural materials which were altered by man to produce a desired textile material.

It has become accepted, and common, practice to color these materials with well-known sulfur and vat dyes. These dyes are water insoluble substances which are readily converted to a water soluble or leuco form by reducing the sulfur or vat dye in, for example, a solution containing an alkali and sodium sulfide or hydrosulfite.

The leuco forms of sulfur and vat dyes are water soluble and well known to be substantive to cellulosic fibers. After application to the fiber, the leuco dye must be oxidized to permanently color the fabric. The process of U.S. Pat. No. 3,775,047 oxidized the dye with an aqueous oxidizing solution including acetic acid and sodium or potassium iodate. U.S. Pat. No. 4,042,319 disclosed similar oxidation with an aqueous oxidant containing acetic or formic acid, an alkali bromate and an alkali iodate. Oxidizing of vat of sulfur dyes with an aqueous agent containing either a bromate or an iodate compound and a vanadium compound was described in U.S. Pat. No. 4,012,192. Such oxidizing solutions are operable; however, it is desired to provide an improved material suitable to oxidize leuco forms of sulfur and vat dyes.

SUMMARY OF THE INVENTION

The oxidant of the present invention is an acidic, aqueous material including ionized bromate, iodate and a soluble vanadium containing material. In one use, leuco sulfur or vat dyes on fibers are contacted with the oxidant for a sufficient time to oxidize a desired or predetermined amount of the leuco material to impart a suitable color to the fibers or fabric.

DESCRIPTION OF THE PREFERRED EMBODIMENTS

The improved herein described oxidant is readily made by mixing together at least one water soluble bromine-containing compound with at least one water soluble iodine-containing compound and at least one water soluble vanadium-containing compound in water. An acid, such as, for example, hydrobromic, hydrochloric, trifluoroethanoic and preferably a lower aliphatic acid containing 1 to 4 carbon atoms is, preferably, thereafter admixed with the solution.

Suitable water soluble bromine-containing compounds are, for example, alkali metal bromates, such as lithium bromate, sodium bromate, potassium bromate, hydrogen bromate, and alkaline earth metal bromates such as magnesium bromate, calcium bromate and strontium bromate. Suitable iodine-containing compounds are, for example, alkali metal iodides, such as lithium iodide, sodium iodide, and potassium iodide; alkaline earth metal iodides, such as magnesium iodide, calcium iodide and strontium iodide; ammonium iodide; hydrogen iodide; iodine monobromide and tribromide; and iodine oxides, such as dioxide ($IO_2$), pentoxide ($I_2O_5$), and nonoxide ($I_4O_9$).

Addition of a soluble vanadium compound to the solution, desirably before addition of the acid, has been found to improve the performance of the solution as an oxidant. The soluble vanadium compound is believed to, at least initially, form the vanadate ion ($VO_4^{-3}$). However, it is thought that other vanadate ions may also be present initially as, for example, $HVO_4^{--}$ or $VO_3^{=}$. Still other vanadate ions may be present in the solution and are within the scope of this invention, for example, $V_3O_9^{-3}$, $V_4O_{12}^{-4}$, $HV_6O_{17}^{-3}$, $HV_{10}O_{28}^{-5}$ and $H_2V_{10}O_{28}^{-4}$. Although it is not necessary to the present invention, and in no way limits such invention, it is known in theory that iodates may complex with vanadates to form more complex iodine-vanadate structures. It is possible that such complexes are formed after the vanadate ion-forming compound is added to the solution.

Other bromine-, iodine- or vanadium-containing materials may be employed providing such material will form the respective bromate, iodate or vanadate ion in the solution.

The described oxidizing material is an aqueous solution with an acidic pH. Oxidation of the leuco sulfur and vat dyes on fibers will occur at any pH below 7, but the rapidity of the oxidation is more commercially acceptable when the pH is about 5 or less. When the pH is lower than about 2.5, there may be a tendency for the oxidizing solution to cause some deterioration of the fibers. Therefore, it is preferred that the oxidizing solution of the present invention have a pH within the range of about 2.5 to about 5. A number of acids are quite satisfactory to impart the acidity to the solution; however, it is preferred that at least one of the lower aliphatic acids, i.e., acetic acid, propionic acid and butyric acid, be employed in an amount sufficient to produce the desired pH. Acetic acid is readily available and has been determined to be commercially satisfactory in solutions for oxidizing leuco dyes.

It is desired, and preferred for optimum performance, that the oxidizing solution, when initially made, contain about 0.4 to about 42 grams per liter (gpl) $BrO_3^-$, about 0.03 to about 12 gpl $IO_3^-$, and about 0.02 to about 8 gpl vanadate ion. More preferably, the acidic solution contains about 0.4 to about 25 gpl $BrO_3^-$, about 0.03 to about 7 gpl $IO_3^-$, and sufficient vanadate ion to produce an about 0.5:1 to about 1:1 vanadate ion to $IO_3^-$ weight ratio. Additional vanadate can be used, but will not affect the performance of the oxidizing solution.

Following is illustrative of one method of making the oxidizing solution. About 0.05 to about 5 (preferably about 0.1 to about 3) weight percent (based on the final weight of the solution) of sodium or potassium bromate is added to water. Sodium or potassium iodide is added to the water in an amount adequate to produce a concentration equal to about 1 to about 25 (preferably about 5 to about 20) weight percent of the sodium or potassium bromate added to the water.

The soluble vanadium compound, such as alkali metal vanadates (such as lithium, sodium, potassium and cesium vanadates), vanadium oxides (such as $V_2O_3$ and $V_2O_5$), vanadium halides (such as $VCl_2$, $VCl_3$, $VCl_4$, $VBr_2$, $VBr_3$, $VI_2$ and $VI_3$), vanadium oxyhalides (such as $(VO)_2Cl$, VOCl and VOBr), alkaline earth metal vanadates (such as $Ca_3V_{10}O_{28}.16H_2O$), and ammonium vanadate is preferably added in an amount equivalent to at least about 20 (preferably about 50 to about 120) weight percent of the sodium or potassium iodide. Sodium and potassium vanadates are most preferred since they are readily available commercially. It is theorized that the vanadate ion, or a more complex vanadium structure present in the solution, acts as a catalyst in the oxidation of iodides to iodates and periodates, and in the oxidation of a leuco sulfur or vat dye. Optionally, a soluble molybdenum compound, for example, alkali metal molybdates, such as sodium and potassium molybdates, ammonium molybdate [$(NH_4)_2MoO_4$], ammonium paramolybdate [$(NH_4)_6MoO_7O_{24}.4H_2O$], $MoO_3.H_2O$ and $H_2MoO_4$ may be added to the oxidizing solution in addition to the vanadium compound.

After the leuco sulfur- or vat dye-treated fibers are prepared for the oxidation step, the dye can be oxidized by procedures well known to those skilled in the art and which are used for other existing oxidizing agents. The temperature of the solution is not critical, but temperatures lower than about room temperature, i.e. about 20° C., may reduce the speed of oxidation sufficiently to be unfeasible in a commercial dyeing operation. Temperatures in excess of about 95° C. may require special equipment and/or begin to cause some deterioration of the fiber. Accordingly, it is preferred that oxidation be carried out within a temperature range of about 20° to about 95° C. Generally, however, temperatures of about 65° to about 75° C. have proven to be acceptable from a rate of oxidation standpoint and minimal deterioration of the fabric.

The normal fabric treatment procedures well known to those skilled in the art to be carried out before and after oxidation of the leuco sulfur- or vat dye-treated fabric are satisfactory in the present process.

The following examples are illustrative of the present invention.

EXAMPLES 1-7

The compositions of Examples 1-7 were formed by mixing with distilled water the amounts of bromate, iodide, vanadate and, in Examples 5 and 6, molybdate, shown in the following Table. After thoroughly mixing such compounds with the water to form a solution thereof, acetic acid was added to the solution in the amounts shown in the table. The solutions were again mixed to obtain a uniform composition and heated to about 70° to 75° C. for a sufficient time (about 2 to about 5 minutes) to produce substantially visually clear solutions.

The oxidizing solution was tested by applying Sodyesul Liquid Brown 7RCF dye (Sodeco Division of Martin Marietta Chemicals Company) to a sample of a standard finely woven 100 percent 80×80 bleached cotton print cloth style number 400 (available from Test Fabrics, Inc., Middlesex, N.J.). The cloth was steamed for one minute and thereafter rinsed in warm water to remove excess dye. Pressure was applied to the fabric to remove excess water. The fabric was then oxidized by dipping in the bromate solution a sufficient number of times to oxidize the dye. Each "dip" cycle time, i.e. the total time of cloth immersion in the solution and time the cloth was in the air between immersions, was about three seconds.

It was determined that the oxidizing solutions of Examples 1-6 were suitable for oxidizing leuco sulfur dyes.

COMPARATIVE EXAMPLES A-F

Examples A-F are identical to compositions of Examples 1-4except that KI or $NaBrO_3$ was not included in Examples A-D, and E and F, respectively. $KIO_3$ was used in Examples E and F to provide the desired iodate ion. It will be observed from the Table that the time to complete oxidation of a leuco sulfur dye was improved when the bromate and iodate were simultaneously present in the catalyzed vanadate oxidizing agent in comparison to when only the bromate or the iodate were present.

OXIDATION OF LEUCO SULFUR DYES

| Example(a) | $NaBrO_3$ | KI | $Na_3VO_4.16H_2O$ | Oxidation Temp. °C. | No. of dips | Time To Complete Oxidation of Dye (Sec.) |
|---|---|---|---|---|---|---|
| 1 | 1.0 | 0.1 | 0.05 | 26 | 3-6 | 9-18 |
| 2 | 1.0 | 0.1 | 0.05 | 70 | 2-4 | 6-12 |
| 3 | 1.0 | 0.1 | 0.1 | 26 | 3-4 | 9-12 |
| 4 | 1.0 | 0.1 | 0.1 | 70 | 1-2 | 3-5 |
| 5 | 1.0 | 0.1 | (c) | 26 | 3-4 | 9-12 |
| 6 | 1.0 | 0.1 | (c) | 70 | 1-2 | 3-6 |
| 7(b) | 1.0 | 0.2 | 0.1 | | | |
| A | 1.0 | (none) | 0.05 | 26 | 4-7 | 12-21 |
| B | 1.0 | " | 0.05 | 70 | 3-6 | 9-18 |
| C | 1.0 | " | 0.1 | 26 | 5-6 | 15-30 |
| D | 1.0 | " | 0.1 | 70 | 4-5 | 12-15 |
| E | (none) | (1.0 $KIO_3$) | 0.1 | 26 | 6-7 | 18-21 |
| F | " | (1.0 $KIO_3$) | 0.1 | 70 | 2-3 | 6-9 |

(a)All quantities are based upon grams per liter of oxidizing solution; unless otherwise noted, 7.5 gpl of acetic acid ($CH_3COOH$) was added to the oxidizing solution (pH of the solution was about 3.9).
(b)Differential pulse polarography analysis showed the solution included 0.25 gpl $KIO_3$ and 0.02 gpl $KIO_4$; bromate, vanadate and other ions not affecting the basic characteristics of the solution as an oxidizing agent were also present.
(c)Solution contained 0.05 gpl $Na_3VO_4.16H_2O$ and 0.05 gpl $Na_2MoO_3.2H_2O$.

What is claimed is:

1. In a method to oxidize dyes on fibers by contacting the fiber with an acidic, aqueous solution containing a bromate and an iodate, the improvement comprising including in the solution a soluble vanadium-containing material capable of forming a vanadate ion.

2. The method of claim 1 wherein the vanadium-containing material is at least one member consisting of alkali metal vanadates and ammonium vanadate.

3. The method of claim 1 wherein the vanadium-containing material is at least one member selected from the group consisting of sodium vanadate and potassium vanadate.

4. A method to oxidize leuco sulfur or vat dyes on fibers comprising contacting said fiber with an acidic, aqueous oxidant including ionized bromate, iodate and a soluble vanadium-containing material for a sufficient time to oxidize the dye.

5. The method of claim 4 including maintaining the composition at a temperature of from about 20° to about 95° C.

6. A method to oxidize leuco sulfur or vat dyes on fibers comprising contacting said fiber with an aqueous solution comprising water in which a sufficient amount of bromine-, iodine- and vanadium-containing materials have been mixed to provide an ion concentration in the solution of about 0.4 to about 42 grams per liter bromate ion, about 0.03 to about 12 grams per liter iodate ion, about 0.02 to about 8 grams per liter vanadate ion and a sufficient amount of a lower aliphatic acid to acidity the solution, for a sufficient time to oxidize the dye.

7. The method of claim 6 including maintaining the composition at a temperature of from about 20° to about 95° C.

* * * * *